United States Patent [19]

Takagiwa et al.

[11] Patent Number: 4,543,311

[45] Date of Patent: Sep. 24, 1985

[54] TONER IMAGE PRESSURE FIXING METHOD

[75] Inventors: Hiroyuki Takagiwa, Hachioji; Syunji Matsuo; Makoto Tomono, both of Hino, all of Japan

[73] Assignee: Konishiroku Photo Industry Co., Ltd., Tokyo, Japan

[21] Appl. No.: 401,857

[22] Filed: Jul. 26, 1982

[30] Foreign Application Priority Data

Jul. 30, 1981 [JP] Japan ..... 56-120472

[51] Int. Cl.[4] ..... G03G 9/08; G03G 9/14

[52] U.S. Cl. ..... 430/98; 430/99; 430/106.6; 430/109; 430/110

[58] Field of Search ..... 430/98, 99, 106.6, 109, 430/110

[56] References Cited

U.S. PATENT DOCUMENTS

| | | | |
|---|---|---|---|
| 3,775,326 | 11/1973 | Westdale | 430/110 X |
| 3,893,932 | 7/1975 | Azan et al. | 430/109 |
| 3,965,022 | 6/1976 | Strong et al. | 430/98 X |
| 4,108,653 | 8/1978 | Peters | 430/109 X |
| 4,254,201 | 3/1981 | Sawai et al. | 430/98 X |

FOREIGN PATENT DOCUMENTS

| | | | |
|---|---|---|---|
| 55-118046 | 9/1980 | Japan | 430/109 |
| 56-29249 | 3/1981 | Japan | 430/106.6 |
| 2004079 | 3/1979 | United Kingdom | 430/109 |
| 2031601 | 4/1980 | United Kingdom | 430/98 |

*Primary Examiner*—Roland E. Martin

*Attorney, Agent, or Firm*—Jordan B. Bierman

[57] ABSTRACT

A pressure fixing method comprising passing a base carrying a toner image through a pair of rollers is disclosed. The toner contains a prepolymer and the rollers are loaded with a linear pressure of from 5 to 70 kg/cm.

41 Claims, No Drawings

TONER IMAGE PRESSURE FIXING METHOD

FIELD OF THE INVENTION

The present invention relates to a method of fixing a toner image formed on the photoreceptor in electrophotography, electrostatic printing or electrostatic recording, and more particularly, to a method for fixing such toner image by pressure.

BACKGROUND OF THE INVENTION

In electrophotography, electrostatic printing or electrostatic recording, the latent image on a photoreceptor is conventionally developed by either of the following two processes: liquid development which uses a liquid developer having fine pigment or dye particles dispersed in a dielectric organic carrier liquid, and dry development which uses a powder developer made of a toner having carbon black or other colorant particles dispersed in a natural or synthetic resin binder, and dry development processes include cascade development, fur brush development, magnetic brush development, impression development and powder cloud development. The dry-developed image is optionally transferred to a receiving sheet, usually paper, and fixed thereto.

In conventional copying machines, the toner image is fixed by pressure alone, or by exposure to solvent vapors or by heating it to fuse to the paper. The third method is conventionally referred to as the thermal fixing process and there are two types: noncontact fusing using an electric oven and contact fusing using heated rollers. Of these fixing methods, fixing by contact fusion is most often used since it achieved high heat efficiency and is suited to electrophotographic copiers and other transfer-type recording apparatuses that are designed for high-speed copying. But this method has several defects: the fixing unit consumes the most power of all the components of the copier; the fixing unit requires heating means; and long warm-up time is necessary, or it takes long for the fixing unit to become "ready" following power application. To eliminate these defects, the pressure fixing method has been proposed. Since the fixing rollers used in this method are not heated, the following advantages are obtained: use of less energy, no pollution hazard, no warm-up time, no chance of the copy to be scorched, high-speed fixing and simplified construction of the fixing unit. These advantages make the pressure fixing mehtod particularly suitable for general-purpose copiers. For all these advantages, however, this method has one great problem, insufficient fixing ability, since, unlike the thermal fusion process wherein the toner is fixed in a molten state, the toner particles are simply crushed (deformed plastically) and forced into the receiving paper.

In the fixing unit, unfixed toner particles are transferred to the surface of the fixing rollers and are replaced on the next coming receiving sheet to foul the toner image on it. This phenomenon is usually called "offset phenomenon" and in the contact fusing method, crosslinking the polymer that is one component of the toner with a crosslinking agent or incorporating a polyolefin of a relatively low weight average molecular weight in the toner is known to be effective for preventing offset phenomenon. But in the pressure fixing method, a far greater pressure is applied to the toner image and metal rollers having great surface energy and poor release properties and used, so the chance of offset phenomenon is greater than in the contact fusing method. What is more, this pressure fixing method has smaller fixing ability than the contact fusing method. Therefore, the toner or antioffset phenomenon means designed for the contact fusing method cannot be directly applied to the pressure fixing method. In particular, the toner for developing an electrostatic latent image that can be used in the pressure fixing method must have not only good fixability but also long keeping quality, great durability, high resistance to moisture and good pictorial rendition.

SUMMARY OF THE INVENTION

Therefore, one object of the present invention is to provide an effective pressure fixing method.

Another object of the invention is to provide an offsetfree pressure fixing method.

These objects can be achieved by a pressure fixing method wherein a support carrying a toner image comprising a prepolymer is passed between a pair of rollers at a linear pressure of 5 to 70 kg/cm.

DETAILED DESCRIPTION OF THE INVENTION

The toner used in the present invention (hereunder referred to as the toner of the present invention) is characterized by containing a prepolymer. The toner is prepared by either of the two basic methods: (1) a monomer is polymerized, the polymer is blended with a prepolymer, colorant and other necessary components, and the blend is kneaded in a molten state; and (2) a prepolymer is dispersed or dissolved in a monomer, and the resulting mix for polymerization is polymerized to partially crosslink the monomer and the prepolymer. In the second method, a colorant and other necessary components may be included in the mix for polymerization before polymerization or they may be dispersed in the resulting polymer by kneading in a molten state. The solid polymer produced by either method is ground and classified, as required, into particles of the desired size (usually from 1 to 50 microns).

In a preferred embodiment, a polymer having the desired particle size can be directly produced by properly selecting the polymerization method and conditions. In this case, by incorporating a colorant and other necessary toner components in the mix for polymerization, the desired toner comprising highly fluid spherical particles can be produced in virtually one step. In a more preferred embodiment, a toner having long keeping quality, chargeability and developability can be produced by microencapsulating the prepolymer-containing polymer prepared by either of the above described methods. Such toner can be produced by any of the known encapsulating methods such as spraydrying, interfacial polymerization, coacervation, phase separation and in-situ polymerization, and details of these methods are described in U.S. Pat. Nos. 3,338,991, 3,326,848 and 3,502,582. The core polymer to be encapsulated may be obtained by any of the polymerization techniques such as suspension polymerization, block polymerization, emulsion polymerization and solution polymerization. A polymerization initiator or a catalyst may be incorporated in the mix for polymerization as required. Suspension polymerization is generally used for making a toner of spherical particles by one step. In suspension polymerization, the mix for polymerization is polymerized as it is suspended as particles of the desired size in a dispersion medium, usually water, under mechanizal agitation. Since the viscosity of the dispersed particles is increased as the polymerization proceeds, a suspension stabilizer is used to prevent the dispersed particles from coalescing together.

There are two basic types of suspension stabilizer, water-soluble high-molecular materials and fine particles of sparingly soluble inorganic compound. The former type includes gelatin, starch and polyvinyl alochol, and the latter type including sparingly soluble salts such as barium sulfate, calcium sulfate, barium carbonate, calcium carbonate and calcium phosphate; inorganic high-molecular materials such as talc, clay, silicic acid and diatomaceous earth; and metal oxides. If the mix for polymerization contains ionic species such as cationic or anionic species (e.g. nitrogen-containing polymerizable monomer or sparingly water-soluble amine) and if its particles are charged either positively or negatively when they are dispersed in water, an ionic dispersant that is charged oppositely when dispersed in water, such as negatively chargeable colloidal silica or positively chargeable aluminum oxide, may be effectively used as a suspension stabilizer.

Agitation is an important element for suspension polymerization and the size of the polymer particles and consistent polymerization depend on the agitation conditions. For a given viscosity of the mix for polymerization and interfacial tension, a shear strass of from $10^3$ to $10^6$ dynes/cm$^2$ is required to provide polymer particles having a size of from 1 to 50 microns.

Suitable monomers that can be used in the present invention are styrenes such as styrene, o-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyren p-methoxystyrene, p-phenylstyrene, p-chlorostyrene and 3,4-dichlorostyrene. Other suitable monomers include α,β-ethylenically unsaturated monoolefins such as ethylene, propylene, butylene and isobutylene; vinyl halides such as vinyl chloride, vinylidene chloride, vinyl bromide and vinyl fluoride; vinylesters such as vinyl acetate, vinyl propionate, vinyl benzoate and vinyl butyrate; α-methylene aliphatic monocarboxylic acid esters such as an acrylate or a methacrylates e.g., methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; acrylic acid or methacrylic acid derivatives such as acrylonitrile, methacrylonitrile and acrylamide; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinyl pyrrole, N-vinyl carbazole, N-vinyl indole, and N-vinyl pyrrolidone; and vinyl naphthalenes. These monomers may be used alone or in combination. They may also be combined in such a manner that they are polymerized to give a copolymer. Other preferable monomers other than those listed above include diolefines such as butadiene.

Any prepolymer may be used in the present invention. Advantageous examples include polybutadienes such as butadiene polymer, α,ω-polybutadiene homopolymer, α,ω-polybutadiene glycol, α, ω-polybutadiene dicarboxylic acid, maleated polybutadiene, polybutadiene modified with acryl at a terminal, and polybutadiene modified with a half ester at a terminal. These prepolymers may be used alone or in combination. Because of their inherent structural characteristics, these polybutadienes have the nature of polyolefins and provide a non-viscous toner. Preferred prepolymers are those which are liquid and viscous at ordinary temperature (25° C.) and have a number average molecular weight of 500 to 5000. In the present invention, the prepolymer is used in an amount of from 1 to 40 wt %, preferably from 5 to 20 wt %, of the monomer.

When the monomer is polymerized in the presence of the prepolymer, it is believed that the polymerization intermediate is partially crosslinked with the prepolymer to form a polymer having high molecular weight that serves as an anti-offsetting agent whereas an uncrosslinked polymer having a relatively low molecular weight, especially one containing an unreacted prepolymer, provides good fixability or the ability to be fixed under pressure alone without heating.

Accordingly, the toner used in the present invention may contain a polymer which is prepared by polymerization of the monomer in the presence of the prepolymer. Such polymer preferably includes polystyrenes, copolymers of styrenes with at least one other α,β-ethylenically unsaturated monoolefin, a copolymers of α,β-ethlenically unsaturated monoolefins and copolymers of styrenes with at least one other butadiene.

To provide a toner more resistant to offset phenomenon, any known anti-offsetting agent may be added during or after the polymerization. A typical example of such optional anti-offsetting agent is a low molecular polyolefin. An advantageous polyolefin has a relatively low melting point and a weight average molecular weight of from about 1000 to 45000. One having a softening point of from 100° to 180° C., particularly 130° to 160° C., is preferred. Specific examples of the polyolefin include polyethylene, polypropylene and polybutylene, and polypropylene is particularly preferred.

The low molecular polyolefin includes a low molecular olefin copolymer which is made of only olefins as monomers, as well as an olefin copolymer having a relatively low molecular weight which is made of an olefin and other monomers. Illustrative olefinic monomers include ethylene, propylene, butene-1, pentene-1, hexene-1, heptene-1, octene-1, nonene-1, decene-1, as well as isomers thereof having unsaturated bonds at different positions, monomers having branched alkyl groups introduced in these monomers such as 3-methyl-1-butene, 3-methyl-2-pentene and 3-propyl-5-methyl-2hexene, and all other olefins. Monomers other than olefinic monomers that form copolymers with the olefinic monomers include vinyl ethers such as vinyl methyl ether, vinyl-n-butyl ether, and vinyl phenyl ether; vinyl esters such as vinyl acetate and vinyl butyrate; haloolefins such as vinyl fluoride, vinylidene fluoride, tetrafluoroethylene, vinyl chloride, vinylidene chloride and tetrachloroethylene; acrylic acid esters such as methyl acrylate, ethyl acrylate, and n-butyl acrylate, as well as methacrylic acid esters such as methyl methacrylate, ethyl methacrylate, n-butyl methacrylate, stearyl methacrylate, N,N-dimethylaminoethyl methacrylate and t-butylaminoethyl methacrylate; acrylic acid derivatives such as scrylonitrile and N,N-dimethylacrylamide; organic acids such as acrylic acid, methacrylic acid, maleic acid, fumaric acid and itaconic acid; and diethyl fumarate and β-pinene.

The low molecular polyolefins used in the present invention consist of those made of only two or more of the olefinic monomers listed above, and those made of at least one of the olefinic monomers listed above and at least one of the monomers other than olefins also listed above. Examples of the former polyolefin include an ethylene-propylene copolymer, ethylene-butene copolymer, ethylene-pentene copolymer, propylenebutene copolymer, propylene-pentene copolymer, ethylene-3-methyl-1-butene copolymer and ethylene-propylene-butene copolymer, and examples of the latter polyolefin include an ethylene-vinyl acetate copolymer, ethylene-vinyl methyl ether copolymer, ethylenevinyl chloride copolymer, ethylene-methyl acrylate copolymer, ethylene-methyl methacrylate copolymer, ethylene-acrylic acid copolymer, propylene-vinyl acetate copolymer, propylene-vinyl ethyl ether copolymer, propylene-ethyl acrylate copolymer, propylene-methacrylic acid copolymer, butene-vinyl methyl ether copolymer, butene-methyl methacrylate copolymer, pentene-vinyl acetate copolymer, hexene-vinyl butyrate copolymer, ethylene-propylene-vinyl acetate copolymer, and ethylene-vinyl acetate-vinyl methyl ether copolymer.

As for the polyolefins that are made up of olefins and other monomers, the olefinic content is preferably as high as possible. This is because the lower the olefinic content, the smaller the release properties necessary for preventing offset phenomenon, and the more impaired the characteristics of the resulting toner, such as fluidity and image forming properties. Therefore, the polyolefin preferably has the highest olefinic content if it also contains monomers other than olefins, and those having an olefinic content of about 50 mol % or higher are effective for the objects of the present invention.

If polyolefins having a weight average molecular weight of less than 1000 are used, toner particles which have low softening point and easily cohere are formed, and if such toner particles are used in electrophotography they considerably foul the photoreceptor or carrier. Therefore, the particles of such toner must be microencapsulated with another resin. If polyolefins having a weight average molecular weight of more than 45000 are used, the resulting toner has too high a softening point to prevent offset phenomenon.

The polyolefins as an anti-offsetting agent are used in an amount of from 1 to 20 parts by weight, preferably from 3 to 15 parts by weight, per 100 parts by weight of the monomers in the mix for polymerization. If their amount is less than one part by weight, they do not provide sufficient and consistent prevention of offset phenomenon. If their amount exceeds 20 parts by weight, a toner of low fluidity is formed. If the mix for polymerization containing the polyolefins as an anti-offsetting agent is polymerized, toner particles each having the polyolefins dispersed uniformly in the resulting polymer is produced. Therefore, even if the low molecular olefins are used in an amount sufficient to achieve the desired prevention of offset phenomenon, a highly fluid toner is formed and no disadvantage such as toner filming on the surface of photoreceptor will occur. As a result, a toner having high fixability and capable of preventing offset phenomenon can always be produced by the method of the present invention, and a visible image having good pictorial rendition can be formed by using such toner.

The low molecular polyolefins can be used in combination with other materials that are effective in preventing offset phenomenon such as metal salts of aliphatic acids (e.g. salts of stearic acid and zinc, barium, lead, cobalt, calcium and magnesium, salts of oleic acid and zinc, manganese, iron and lead, as well as salts of palmitic acid and zinc, cobalt and magnesium); higher aliphatic acids and alcohols having 17 or more carbon atoms; polyvalent alcohol esters; natural or synthetic paraffins; aliphatic acid esters or partially saponified aliphatic acid esters; and alkylene bisaliphatic acid amides (e.g. ethylene bisstearoylamide).

A suitable pigment or dye can be incorporated in the toner of the present invention as a colorant. Illustrative colorants include carbon black, nigrosine dye (C.I. No. 50415B), aniline blue (C.I. No. 50405), chalcooil blue (C.I. No. azoec Blue 3), chrome yellow (C.I. No. 14090), ultramarine blue (C.I. No. 77103), Du Pont oil red (C.I. No. 26105), Orient oil red #330 (C.I. No. 60505), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), Rose Bengale (C.I. No. 45435), oil black and, azooil black. These colorants may be used either alone or in combination. They may be incorporated in an amount of about 3 to 20 wt % of the final toner. If the toner contains fine magnetic particles as will be described later, they may be used as a colorant. For a microencapsulated toner, the colorant may be incorporated in either the core or shell or both.

Any conventional polymerization initiator may be used in an ordinary temperature range for polymerizing the monomers listed above. Specific polymerization initiators include benzoyl peroxide, lauryl peroxide, 2,2'-azobisisobutyronitrile, 2,2'-azobis-(2,4-dimethylvaleronitrile), benzoyl orthochloroperixide and benzoyl orthomethoxyperoxide. The polymerization may be effected under atmospheric or super-atmospheric pressure.

According to the present invention, a one-component magnetic toner can be produced by incorporating fine magnetic particles in the toner particles. Suitable magnetic materials are those which are intensely magnetized in the direction of a magnetic field, and they are preferably black and chemically stable, and more preferably, they are in a fine particulate form having a size of one micron or less. Therefore, magnetite {iron (II-,III) oxide} is the most preferred. Typical magnetic materials or magnetizable materials include metals such as cobalt, iron and nickel; alloys or mixtures of metals such as aluminum, cobalt, copper, iron, magnesium, nickel, tin, zinc, antimony, beryllium, bismuth, cadmium, calcium, manganese, selenium, titanium, tungsten and vanadium; metal compounds containing metal oxides such as aluminum oxide, iron oxide, copper oxide, nickel oxide, zinc oxide, titanium oxide and magnesium oxide; refractory nitrides such as vanadium nitride and chromium nitride; carbides such as tungsten carbide and silica carbide; ferrite and mixture thereof. These magnetic materials are preferably in the form of fine particles having a size of from about 0.01 to 1 micron. They are contained in the toner in an amount of from about 50 to 300 parts, preferably from 50 to 200 parts, by weight for 100 parts by weight of the polymer. More preferably, they are used in an amount of from 90 to 150 parts by weight for 100 parts by weight of the polymer. Like the colorant, the fine magnetic particles may be incorporated in the mix for polymerization or dispersed in the polymer by kneading in a molten state. For a microencapsulated toner, they may be incorporated in either the core or shell or both.

The toner of the present invention may optionally contain a charge control agent such as nigrosine that is conventionally used in toners. For a microencapsulated toner, such charge control agent may be incorporated in either the core or shell or both.

To make a microencapsulated toner, the shell may be made of any material, and preferred materials are those which form a uniform film around the core, have good chargeability, do not cohere together and which do not interfere with the pressure fixability of the toner. Suitable examples include homopolymers of styrene or their derivatives such as polystyrene, poly-pchlorostyrene, and polyvinyl toluene; styrene copolymers such as styrene-butadiene copolymer, styrene-acrylic acid copolymer and styrene-maleic anhydride copolymer; polyester resins, acrylic resins, xylene resins, polyamide resins, ionomer resins, furan resins, ketone resins, terpene resins, phenol-modified terpene resins, rosins, rosin-modified pentaerythritol esters, natural resin-modified phenolic resins, natural resin-modified maleic acid resins, cumaroindene resins, maleic acid-modified phenolic resins, alicyclic hydrocarbon resins, petroleum resins, cellulose phthalate acetate, metylvinyl ether-maleic anhydride copolymer, starch graft polymers, polyvinyl butyral, polyvinyl alcohol, polyvinyl pyrrolidone, chlorinated paraffin, wax, aliphatic acid and cyclized rubber. These compounds may be used either alone or in combination. Particularly preferred examples are styrene resins, polyester resins, maleic acid-modified phenolic resins, cellulose phthalate acetate, starch graft polymers, polyvinyl butyral and cyclized rubber. These shell-forming compounds are described in Japanese patent applications (OPI) Nos. 64251/80, 4549/78, 36243/78 (the symbol OPI as used herein means an unexamined published Japanese patent application), Japanese Patent Publications Nos. 21098/79, 8104/79, 31994/79, and C.L. Harpavat: IEEE-IAS Annual Meeting, 236 (1978).

According to the fixing method of the present invention, a base carrying a toner image is passed between a pair of rollers at a linear pressure of 5 to 70 kg/cm. Usually the rollers need not be heated, but to achieve better fixation, the rollers may be heated at 100° C. or lower with auxiliary heating means. For details of the pressure fixing apparatus that can be used in the present invention, see Japanese Patent Publication No. 12797/69, U.S. Pat. Nos. 3,269,626, 3,612,682, 3,655,282 and 3,731,358. According to the present invention rigid metal rollers capable of withstanding the linear pressure specified above should be used. The rollers are preferably loaded with a linear pressure of 10 to 40 kg/cm. If the linear pressure is less than 5 kg/cm, the result of fixing is far from being satisfactory, and if the pressure exceeds 70 kg/cm, the fixed image glares excessively to make the copy hard to read, or the receiving paper wrinkles easily or may even break.

The present invention is now described in greater detail by reference to the following examples which are given here for illustrative purposes only and are by no means intended to limit the scope of the invention. In the examples, all parts are by weight.

EXAMPLE 1

A mixture of the following components was agitated in a ball mill for about 24 hours.

| | |
|---|---|
| Picolastic D-150 (styrene resin from Esso Petrochemical Co., Ltd.) | 70 parts |
| Dianar BR-102 (poly-n-butyl methacrylate from Gokyo Sangyo K.K.) | 30 parts |
| Diablack SH (carbon black from Mitsubishi Chemical Industries Limited) | 5 parts |
| NISSO-PGB-1000 (α, ω-polybutadiene glycol from Nippon Soda Co., Ltd.) | 10 parts |

The mixture was keaded with heated rolls, cooled and ground to particles having an average size of 13 microns. The resulting toner was referred to as Sample A of the present invention. A control toner was made by repeating the same procedure except that NISSO-PGB-1000 was not used. Five parts of each sample was mixed with 95 parts of a carrier iron powder DSP of Dowa Teppun Kogyo K.K. to make two developers. Using an electrostatic copier "U-Bix V" of Konishiroku Photo Industry Co., Ltd., electrostatic latent images were formed, and developed with the two sample developers to form toner images, which were transferred to receiving paper (64 g/m$^2$) and fixed by being passed through a pair of chrome-plated metal rollers under a linear pressure of 20 kg/cm at a linear speed of 120 mm/sec. The fixability of the toner image was evaluated by rubbing the surface of the fixed image with a rubbing sheet. Some toner particles of Sample A were dislodged from the paper support but their amount was too small to present a problem in practical applications. Considerable dislodging of toner particles occured in the comparative sample and the result of fixing was far from being satisfactory. The anti-offsetting properties were evaluated by the following method: After receiving paper carrying a toner image was passed between the rollers white, receiving paper carrying no toner particles was passed through the rollers under the same conditions to see if that paper was stained by toner particles. A slight degree of offset phenomenon was observed with Sample A of the present invention.

EXAMPLE 2

A mix for polymerization was prepared by blending the following components.

| | |
|---|---|
| Styrene | 70 parts |
| n-Butyl methacrylate | 30 parts |
| Raven 1250 (carbon black from Columbina Corporation) | 5 parts |
| Oil black BW (charge control agent from Orient Chemical Industry Co., Ltd.) | 0.2 part |
| Azobisisobutyronitrile | 3 parts |
| NISSO-PBG-1000 | 10 parts |
| Viscol 550P (low-molecular polypropylene from Sanyo Chemical Industries, Ltd.) | 5 parts |

The mix was added to a 0.6 wt % aqueous polyvinyl alcohol in a 2000-ml separable flask, and under stirring, the solution was heated to 85° C. at which temperature it was held for 6 hours to effect polymerization. The reaction mixture was cooled, the solid matter was separated, centrifiged, dried and ground to particles having an average size of 13 microns. The resulting toner was referred to as Sample B of the present invention. Another toner sample was prepared by repeating the same procedure except that Viscol 550P was not used. The toner was referred to as Sample C. The toner fixability and anti-offsetting properties of the respective samples were checked as in Example 1. Either sample had good toner fixability and anti-offsetting properties, and could be used for 1000 cycles of copying without any toner particles being deposited on the surface of the fixing rollers, but after 2000 cycles of copying, some toner particles of Sample C were deposited on the rollers.

EXAMPLE 3

A mix for polymerization was prepared by blending the following components.

| | |
|---|---|
| Styrene | 40 parts |
| Butadiene | 50 parts |
| Carbon Black MA-600 (from Mitsubishi Chemical Industries Limited) | 5 parts |
| Lauroyl peroxide | 2 parts |
| NISSO-PBG-1000 | 10 parts |
| Low-molecular ethylene-propylene copolymer (wt. av. m. wt. = 4000) | 10 parts |

The mix was added to a 1.25 wt % aqueous polyvinyl alcohol solution in a 2000-ml separable flask, and under stirring with a TK homomixer of Tokusha Kika Kogyo Co., Ltd. at 3000 rpm, the solution was heated to 65° C. at which temperature it was held for 30 minutes. Then, the solution was subjected to polymerization for 6 hours under stirring with a conventional stirrer at 100 rpm. After completion of the polymerization, the solid particles were filtered off and dried to obtain toner particles having an average size of 13 microns. They were then dispersed in a liquid of the following composition.

| | |
|---|---|
| Alpex CK 450 (cyclized rubber from Hoechst Aktiengesellschaft, iodine value = 165, av. m. wt. = 10000) | 50 parts |
| Xylene | 500 parts |

Encapsulated toner particles having a size of 15 to 20 μm were prepared from the dispersion with a spray dryer of Mitsubishi Kakoki Kaisha, Ltd. That toner was referred to as Sample D. Its fixability and anti-offsetting properties were checked as in Example 1; it was found to have good fixability and anti-offsetting properties. Sample D could provide a sharp clean image even after 30,000 cycles of copying, and no toner filming occured on the receptor surface.

EXAMPLE 4

The fixability of Sample D was checked by repeating the procedure of Example 1 except that the linear pressure of the fixing rollers was changed between 1 and 70 kg/cm. The results are shown in Table 1.

TABLE 1

| linear pressure (kg/cm) | fixability | linear pressure (kg/cm) | fixability |
|---|---|---|---|
| 1 | X | 30 | O |
| 2 | X | 35 | O |
| 3 | X | 40 | O |
| 4 | Δ | 45 | O |
| 5 | Δ~O | 50 | O |
| 10 | O | 55 | O |
| 15 | O | 60 | O |
| 20 | O | 65 | O |

TABLE 1-continued

| linear pressure (kg/cm) | fixability | linear pressure (kg/cm) | fixability |
|---|---|---|---|
| 25 | O | 70 | O |

O: good fixability, Δ: fair fixability, X: poor fixability

Table 1 shows that the desired fixing was not obtained at linear pressures of less than 5 kg/cm. At pressures of more than 70 kg/cm, the desired fixing was obtained, but there were many cases of glaring copy image and broken receiving paper.

What is claimed is:

1. A pressure fixing method comprising passing a support carrying a toner image through a pair of rollers, said toner image consisting essentially of a toner which comprises a polybutadiene prepolymer having a number average molecular weight of up to 5000 and a polymer, wherein said polymer is admixed with, or polymerized in the presence of, said prepolymer, and said rollers are loaded with a linear pressure from 5 to 70 kg/cm, said prepolymer being present in an amount of from 1% to 40% by weight of said polymer.

2. A pressure fixing method according to claim 1, wherein said prepolymer is liquid at ordinary temperature.

3. A pressure fixing method according to claim 1, wherein said prepolymer has a number average molecular weight of 500 to 5000.

4. A pressure fixing method according to claim 1 wherein said toner contains a polymer being prepared by polymerizing a monomer in the presence of said prepolymer.

5. A pressure fixing method according to claim 4, wherein said monomer is an α,β-ethylenically unsaturated monoolefine or a diolefine.

6. A pressure fixing method according to claim 5, wherein said α,β-ethylenically unsaturated monoolefine is a styrene or an α-methylene aliphatic monocarboxylic acid ester.

7. A pressure fixing method according to claim 5, wherein said diolefine is a butadiene.

8. A pressure fixing method according to claim 6, wherein said styrenes is styrene.

9. A pressure fixing method according to claim 6, wherein said α-methylene aliphatic monocarboxylic acid ester is an acrylate or a methacrylate.

10. A pressure fixing method according to claim 4, wherein said toner further comprises an antioffsetting agent.

11. A pressure fixing method according to claim 10, wherein said antioffsetting agent is a low molecular polyolefine.

12. A pressure fixing method according to claim 11, wherein said low molecular polyolefine has a weight average molecular weight of 1000 to 45,000.

13. A pressure fixing method according to claim 11, said low molecular polyolefine has a softening point of from 100° to 180° C.

14. A pressure fixihg method according to claim 11, said low molecular polyolefine is a polyethylene, a polypropylene or a polybutylene.

15. A pressure fixing method according to claim 4, wherein said toner further comprises a magnetic material.

16. A pressure fixing method according to claim 10, wherein said toner further comprises a magnetic material.

17. A pressure fixing method according to claim 10, wherein said toner further comprises a magnetic material.

18. A pressure fixing method according to claim 15, wherein said magnetic material is a magnetite.

19. A pressure fixing method according to claim 16, wherein said magnetic material is a magnetite.

20. A pressure fixing method according to claim 17, wherein said magnetic material is a magnetite.

21. The pressure fixing method of claim 4 wherein said polymer is selected from the group consisting of a polystyrene, a copolymer of a styrene with at least one other $\alpha,\beta$-ethylenically unsaturated mono olefin, a copolymer of $\alpha,\beta$-ethylenically unsaturated mono olefins, and a copolymer of a styrene with at least one other butadiene.

22. A pressure fixing method according to claim 15, wherein said toner further comprises an antioffsetting agent.

23. A pressure fixing method according to claim 22, wherein said antioffsetting agent is a low molecular polyolefine.

24. A pressure fixing method according to claim 23, wherein said low molecular polyolefine has a weight average molecular weight of 1000 to 45000.

25. A pressure fixing method according to claim 23, said low molecular polyolefine has a softening point of from 100° to 180° C.

26. A pressure fixing method according to claim 23, said low molecular polyolefine is a polyethylene, a polypropylene or a polybutylene.

27. A pressure fixing method according to claim 1, wherein said toner comprises a core including the prepolymer and a shell formed around said core.

28. A pressure fixing method according to claim 27, wherein said core contains a polymer being prepared by polymerizing a monomer in the presence of said prepolymer.

29. A pressure fixing method according to claim 27, wherein said prepolymer is a polybutadiene.

30. A pressure fixing method according to claim 28, wherein said monomer is an $\alpha,\beta$-ethylenically unsaturated monoolefine or a diolefine.

31. A pressure fixing method according to claim 1, wherein the linear pressure is between 10 and 40 kg/cm.

32. A pressure fixing method according to claim 1 or 22, wherein a fixing temperature of said method is at 100° C. or lower.

33. A pressure fixing method according to claim 1, wherein said toner further comprises a magnetic material.

34. A pressure fixing method according to claim 33, wherein said magnetic material is a magnetite.

35. A pressure fixing method according to claim 27, wherein said core comprises a magnetic material.

36. A pressure fixing method according to claim 32, wherein said magentic material is a magnetite.

37. A pressure fixing method according to claim 32, wherein said fixing temperature is at ordinary temperature.

38. A pressure fixing method according to claim 1, wherein said rollers are not heated.

39. A pressure fixing method according to claim 1, wherein at least one roller of said rollers is heated at 100° C. or lower.

40. A pressure fixing method comprising passing a support carrying a toner image through a pair of rollers, said toner image consisting essentially of a toner which comprises a polybutadiene glycol prepolymer, and said rollers being loaded with a linear pressure of from 5 to 70 kg/cm.

41. A pressure fixing method comprising passing a support carrying a toner image through a pair of rollers, said toner image consisting essentially of a toner which comprises a polymer and a polybutadiene glycol prepolymer wherein said polymer is admixed with, or polymerized in the presence of, said prepolymer, and said rollers are loaded with a linear pressure of from 5 to 70 kg/cm.

* * * * *